US005906530A

United States Patent [19]

Lindsey

[11] Patent Number: 5,906,530

[45] Date of Patent: May 25, 1999

[54] POLYHEDRAL STRUCTURAL SYSTEMS

[76] Inventor: Alan Lindsey, 213 Richland Dr. East, Mandeville, La. 70448

[21] Appl. No.: 09/067,538

[22] Filed: Apr. 27, 1998

Related U.S. Application Data

[63] Continuation of application No. 08/657,650, May 30, 1996, Pat. No. 5,743,786.

[51] Int. Cl.[6] ..... A63H 33/06

[52] U.S. Cl. ..... 446/85; 446/221

[58] Field of Search ..... 446/85, 220, 221, 446/222, 223, 224, 225, 226

[56] References Cited

U.S. PATENT DOCUMENTS 5,743,786 4/1998 Lindsey ..... 446/85

*Primary Examiner*—William H. Grieb
*Attorney, Agent, or Firm*—Joseph T Regard, Ltd.

[57] ABSTRACT

A system for releasably joining balloons and the like to form a structure, novelty, educational, or play item. The present invention comprises a modular system of inflated cells having connection members placed about each cells periphery, said cells configured to form various polyhedral shapes. The preferred embodiment of the present invention teaches the utilization of generally ellipsoidal balloons of a non-elastomeric material, such as MYLAR, each said ellipsoid forming a cell, and being configured to selectively engage neighboring balloons to form generally radial or other multi-celled structures. While the preferred embodiment of the present system contemplates the utilization of hook and loop fasteners, such as VELCRO, for joining the cells, alternative modes of releasable attachment are also contemplated such as adhesives, ties, tape, and shrink wrap. The present system in effect creates a double-walled structure (which walls may be inflated) which utilizes an attachment configuration which provides for enhanced structural integrity, as well as diversity and flexibility in terms of the alternative configured structures and items which may be fabricated utilizing the present system. An alternative embodiment of the present invention contemplates a multi-celled, releasably joined inflatable structure which may be assembled in such a manner as to form a cushion and simulate an explosive impact, upon a user falling or jumping upon same.

13 Claims, 7 Drawing Sheets

POLYHEDRAL STRUCTURAL SYSTEMS

STATEMENT OF CONTINUING APPLICATIONS

The present application is a Continuation of U.S. patent application Ser. No. 08,657,650, filed May 30, 1996, entitled "Balloon Face Polyhedra", issuing as U.S. Pat. No. 5,743,786 on Apr. 28, 1998, listing Alan Lindsey as inventor.

TECHNICAL FIELD OF THE INVENTION

This invention relates to multi-celled, releasably joined inflatable structures, and in particular to a system for releasably joining balloons and the like to form a structure, novelty, educational, or play item. The present invention also relates to educational devices, static structures, large balloons, toys, and space structures.

The present invention comprises a modular system of inflated cells having connection members placed about each cells periphery, said cells configured to form various polyhedra.

The preferred embodiment of the present invention teaches the utilization of generally ellipsoidal balloons made of a non-elastomeric material, such as MYLAR, each said ellipsoid forming a cell, and being configured to selectively engage neighboring balloons to form generally radial or other multi-celled structures, for example, a polyhedral sphere or half sphere, a generally toroidally configured structure, a toy bridge, or linear structures.

While the preferred embodiment of the present system contemplates the utilization of hook and loop fasteners, such as VELCRO for joining the cells, alternative modes of releasable attachment are also contemplated, such as, for example, adhesives, ties, tape, and shrink wrap.

The present system in effect creates a double-walled structure (which walls may be inflated) which utilizes an attachment configuration which provides for enhanced structural integrity, as well as diversity and flexibility in terms of the alternative configured structures and items which may be fabricated utilizing the present system.

An alternative embodiment of the present invention contemplates a multi-celled, releasably joined inflatable structure which may be assembled in such a manner as to form a cushion and simulate an explosive impact, upon a user falling or jumping upon same.

BACKGROUND OF THE INVENTION

U.S. Patents covering technologies pertinent to the present invention include:

| U.S. Pat. No. | Inventor | Date of Issue |
|---|---|---|
| 5333817 | Kalisz | 09/02/1994 |
| 5285986 | Hagenlocher | 02/15/1994 |
| 5115998 | Olive | 05/26/1992 |
| 5004633 | Lovik | 08/02/1991 |
| 4971269 | Koda | 11/20/1990 |
| 4966568 | Nakamura | 10/30/1990 |
| 4934631 | Birbas | 06/19/1990 |
| 4833837 | Bonneau | 05/30/1989 |
| 4766918 | Odekirk | 09/30/1988 |
| 4758199 | Tillotson | 07/19/1988 |
| 4711416 | Regipa | 12/08/1987 |
| 4434958 | Rougeron | 03/06/1984 |
| 4384435 | Polise | 05/24/1983 |
| 4113206 | Wheeler | 09/12/1978 |
| 4114325 | Hochstein | 09/19/1978 |
| 4024679 | Rain | 05/24/1977 |

-continued

| U.S. Pat. No. | Inventor | Date of Issue |
|---|---|---|
| 4004380 | Kwake | 01/25/1977 |
| 3816885 | Saether | 06/18/1974 |
| 3744191 | Bird | 07/10/1973 |
| 3676276 | Hirshen | 07/11/1972 |
| 3620485 | Gelhard | 11/16/1971 |
| 3490184 | Bird | 01/20/1970 |
| 3456903 | Papst | 07/22/1969 |
| 3384328 | McGee | 05/21/1968 |
| 3369774 | Struble | 02/20/1968 |
| 3332176 | Knetzer | 07/25/1967 |
| 3247627 | Bird | 04/26/1966 |
| 3277724 | Lundeberg | 10/11/1966 |
| 2996212 | O'Sullivan | 09/15/1961 |
| 2986242 | Clevett | 05/30/1961 |
| 2463517 | Chromak | 03/08/1949 |

The art of building composite structures of inflatable members spans many fields. Most common are structures built of latex balloons. These typically involve decorative bundles of balloons tied together and possibly tied to a supporting structure, such as an arch. These structures are time-consuming to construct due to difficulties in getting the balloons adjusted into desired geometries and it is impractical to deflate the balloons and leave the decorative arrangement intact. The balloons are typically used only once and then discarded. In addition, the balloons frequently fail during construction and strings become tangled causing frustration.

Another commonly seen method for building structures of multiple balloons is the art commonly seen in circuses of tying elastomeric balloons together to form animals and the like. This method requires considerable study, relies on latex balloons, does not form figures that are easily disassembled, and is not well suited to the construction of large structures.

U.S. Pat. No. 4,892,500 describes a network of elastomeric multi-spout balloons connected by plugs meant to remedy the difficulties in maintaining desired geometry. However, these structures rely on rigid devices for support and therefore compromise air-floatability. They are also quite complicated to interconnect, and rely on fragile latex balloons.

U.S. Pat. No. 4,944,709, describes three dimensional balloon sculptures and building blocks. These sculptures also seek to remedy the geometry problem by relying entirely on rod-like members keeping balloons in place. Air floatability is compromised, and the uses of the final structure are limited to static display.

A number of other means of connecting balloons have been presented, one example is U.S. Pat. No. 5,378,186. Here the connections are very complex and are designed to connect two non-elastomeric balloons together to form a single figure, as in a dog with a head. The method used by U.S. Pat. No. 5,378,186 involves two balloons joined by a tab on one balloon and a collar on another. It suffers from being time-consuming to use and the method can only be applied to a limited range of geometries.

U.S. Pat. No. 5,273,477 describes inflatable interlockable blocks with frictionally releasable interlocking tongues and grooves. These blocks are substantially two dimensional, since the faces of the blocks are connected together at a pattern of points other than the seams. These structures are not typically envisioned as being air-floatable and most require great size to achieve the required surface/volume ratio for lift with helium. In addition, they use frictional fastening systems and so cannot be used as a ball, require a very specialized shape for engagement, and have difficulty maintaining structural integrity in various states of inflation due to the reliance on a particular balloon shape for fasten ability.

U.S. Pat. No. 5,145,440 uses tube-like inflatable interlockable members with junctions stabilized by hook-and-loop fasteners to form life-size play structures shaped like log cabins. These structures are not typically envisioned as being air-floatable and require great size to achieve the required surface/volume ratio for lift with helium. In addition, they do not come apart readily since they are connected with both frictional and contact fasteners, with contact fasteners buried in the junction. They also are highly restrictive as to shape.

A water-puzzle currently being sold is composed of six inflatable rings connect able into a cube and other configurations by a total of seventy two grommets and thirty six split rings. This device with faces thirty inches across in the uninflated state weighs eighteen hundred grams and requires twenty minutes to assemble and disassemble. This device displays poor structural integrity when assembled.

Other inflatable toys commonly sold are of pre-connected inflatable members that are not typically re-configurable and have no special structural properties.

U.S. Pat. No. 4,836,787 describes a set of planar regular polygonal elements joined by hook-and-loop fasteners. These elements are not air-floatable, are rigidly restricted in geometry, and can be unsafe when thrown around the room by children.

U.S. Pat. No. 4,650,424 describes a toy for demonstrating characteristics of a latticework of space points based on gravity stacked ellipsoidal elements which may be optionally connected by hook-and-loop fasteners. The strong dependence on gravity in this patent precludes any designs for air-floatability. This patent is useful in locating where to place fasteners for spherical elements of a particular lattice, but does not describe the geometries of the contact fastening elements themselves.

Poole, in "Tensional Structures", demonstrates a half-dome constructed of inflatable hexagons and pentagons of plastic foil. This structure is not reconfigurable and as designed could not be assembled if the faces were individually inflated prior to connection into a structure, since the connections between balloons are too short to accommodate the three dimensional faces. This is not a problem for the housing-type applications this half-dome is designed for, and in fact is desirable since it increases the rigidity of the structure through pre-stressing as the dome is inflated.

Minke, in "Tensional Structures", demonstrates polyhedra built of flexibly connected inflatable polygons with internal frames. These structures cannot be made readily air-floatable, cannot act as one polygon on one side and another polygon on the other, and avoid challenges associated with three dimensional faces by using a frame so that faces can be treated as two dimensional objects.

The prior art for large inflatable balloons relies on large gores being sewn together to form a single large envelope. This technique is not suited to automated manufacture, and the resulting balloons are of a fixed shape.

U.S. Pat. No. 5,115,998 describes a double-walled annular balloon for satellite protection. This balloon requires 178 psi. to be inflated on earth and is designed to be permanently assembled into only one configuration.

Each instance of prior art suffers from a number of shortcomings this invention attempts to remedy.

GENERAL, SUMMARY DISCUSSION OF THE INVENTION

Unlike the prior art, the present invention provides a cost effective, easily learned and implemented system for removably attaching a plurality of cells to form various multi-celled, diversely configured structures. In the alternative, the present invention may be implemented to form a safe, yet amusing recreational toy, to form a cushion which the user may fall upon, thereby simulating an explosive impact, while cushioning the user's fall.

The preferred embodiment of the present invention may utilize off-the-shelf non-elastomeric, inflated balloons of MYLAR or the like, and may have a generally ellipsoidal shape. The balloon further has placed thereon, spaced in generally equilateral fashion, a connector, said connector positioned at a calculated and thereby pre-determined "natural" connection point for each balloon. The connector may comprise respective male and/or female contact fasteners, such as the hooks and loops of VELCRO, for removably affixing said balloon to neighboring balloons.

In the general case, connection areas are determined using the fully inflated topologies of balloons which are aligned to the faces of a polyhedron being approximated. If polar contact fasteners are used, then they should be arrayed such that for each edge of a face of a polyhedron being approximated, for example a cube, male and female or positive and negative fasteners maintain a consistent left and right relationship to one another relative to an observer viewing the cell from the interior of the approximated polyhedron. Only in this fashion will the balloon faces readily attach to one another. Without this consistent symmetry, users will require a map to determine how to connect the cells for all but very simple polyhedra.

The term "natural" connection point is used to facilitate discussion of fastener placement. The "natural" connection point is typically the center of an area of tangency between two neighboring balloons, in forming a polyhedron. It is always within the connection area, which is defined as the area of tangency between adjacent balloon cells.

The "natural" connection points have several important features. They are the points on the surface of a balloon where it can connect to other balloons in the desired figure with no distortion of the balloon shape required for the balloons to connect. These "natural" connection points are also the points requiring minimum stress on the connection, for structural integrity and requiring minimum contact area between balloons. Using contact fasteners at the connection points provides a connection with resistance to both torque and shear, quick connection without tools, and a minimum number of parts to assemble for a complete figure.

The present invention provides balloon-face polyhedra composed of elements with maximally differentiated functionality in simple, synergetic combination. As a result, a wide variety of needs may be filled by optimizing particular components for a given application. The components, or connecting balloons or cells forming the present invention are configured to strictly adhere to the plug-in component principle, so that damaged components may be readily replaced with a minimum of down-time.

The present invention provides many advantages over the prior art. The structures of the present invention do not require exterior structural support, allowing for structures made according to this invention to be light weight, and thereby air-floatable. In addition, the contact fastening system used is vastly easier to use than other prior art systems such, as the multi-spout plug system of U.S. Pat. No. 4,892,500. Balloon-face polyhedra are also readily configurable into decorative patterns, and may be either deflated in one piece for storage or disconnected and deflated, remain fastened when kicked around the room as a ball, and yet disconnect readily when desired. The fastening system is not reliant on balloon shape and therefore frees the designer to use a multitude of face shapes and relieves concerns about the structure retaining its integrity under various states of inflation.

In comparison to prior art, a cube circular-balloon-face polyhedron with faces seventeen and three eighths inches across in the uninflated state weighs only one hundred grams, only requires forty seconds to assemble and five seconds to disassemble. The assembly time is only two percent of that required for prior art water puzzle referenced infra. In addition, balloon-face polyhedra may be designed such that faces act as squares on one side and another polygon on the other, and are very structurally sound.

An alternative of the present invention contemplates a generally spherically configured, multi-celled polyhedral structure, each cell comprising a separate balloon removably affixed to its neighbors via contact fasteners such as hook and loop or the like. The contact fasteners of the system of the present invention act as mechanical fuses ensuring that the structure fails gracefully and reconstructably, while also resisting torque and shear at the connection. Such a balloon-face polyhedra may also be utilized for other functions, such as forming what would appear to be a large, single balloon unit, or providing a transportable, large inflatable ball. Since a configuration could be quickly disconnected, disassembled and transported readily without the delays associated with deflating and re-inflating single cell large balls.

Balloon-face polyhedra can form many figures not possible with rigid members. The system of the present invention, being extremely lightweight, can thus be used in methods entirely uncontemplated by U.S. Pat. No. 4,650,424, such as structures that are hollow in the middle and structures that float in air.

Spheres are known to be the strongest inflatable members possible. The present invention provides a means of taking advantage of this trait where many other inflatable polyhedral designs rely on virtual 2 dimensionality for their connection systems to work.

The system of the present invention provides diverse opportunities for forming various configured structures, approximating any of the shapes large balloons typically take, such as cartoon figures. Since the system of the present invention comprises multi-component objects, it can be broken down into faces readily produced on modern toy balloon manufacturing equipment at low cost. Further, unlike some large inflated buildings and related structures, the system of the present invention does not require continuous air-blower support.

The system of the present invention may also form balloon-face polyhedra for use as air-filled shells over a helium-filled lift balloon. With this configuration, a balloon can maintain its beautiful shape indefinitely though lift be lost as helium leaks out of the lift balloon.

In summary, the Balloon-face polyhedral structure system offers many advantages over the prior art:

1) extreme ease of assembly
2) no reliance on frameworks
2) ultimate ease of disassembly
3) easily configured in different ways to form many different shapes
4) safe for play
5) air-floatable at small size
6) superior structural integrity due to 3D nature of the faces
7) readily decorated to suit any occasion
8) well suited to automated manufacture It is the object of Balloon-face Polyhedra to provide light, beautiful, strong, safe, and multi-configurational structures for play, education, enclosure, and protection. This and further objects of the invention are provided by polyhedral structure elements composed of balloons and contact fasteners designed to connect at natural connection points.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

REFERENCE NUMERALS IN DRAWINGS

Figure 1:
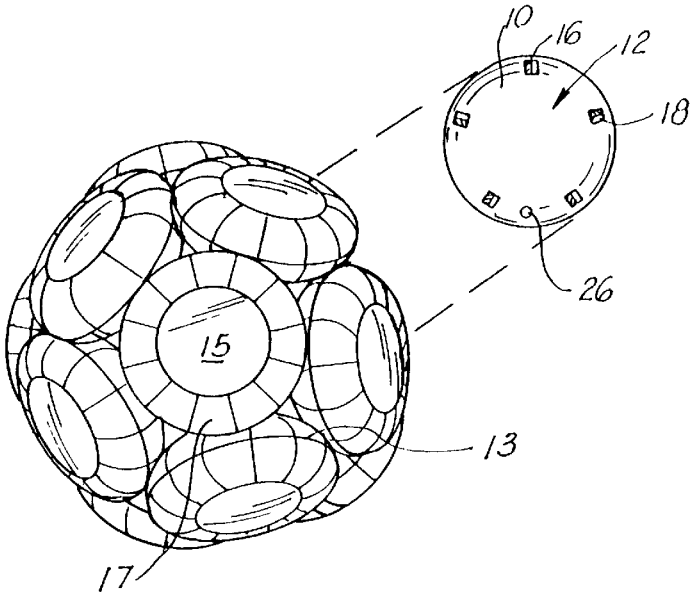
FIG. 1 is an isometric view of a dodecahedral circular balloon-face polyhedron formed using the system of the present invention.

10 envelope
11 wall
12 balloon
13 peripheral edge of balloon
14 contact fastener
15 central area of balloon
16 positive polarity or male contact fastener
17 transitional area from 13 to 15
18 negative polarity or female contact fastener
20 uninflated diameter
22 connection point
24 seam
26 valve
36 cover
38 sewn seam
100 cube
103 balloon 1
104 envelope 1
105 outer surface 1
106 peripheral edge 1
107 face 1 of cube
108 balloon 2
109 envelope 2
110 outer surface 2
111 peripheral edge 2
112 face 2 of cube
113 connection area
115 balloon 3
116 outer surface 3
117 peripheral edge 3
118 face 3 of cube
119 Connection area
120 balloon 4
121 balloon 5
122 balloon 6
124 Connection area

DETAILED DISCUSSION OF THE INVENTION

Figure 2:
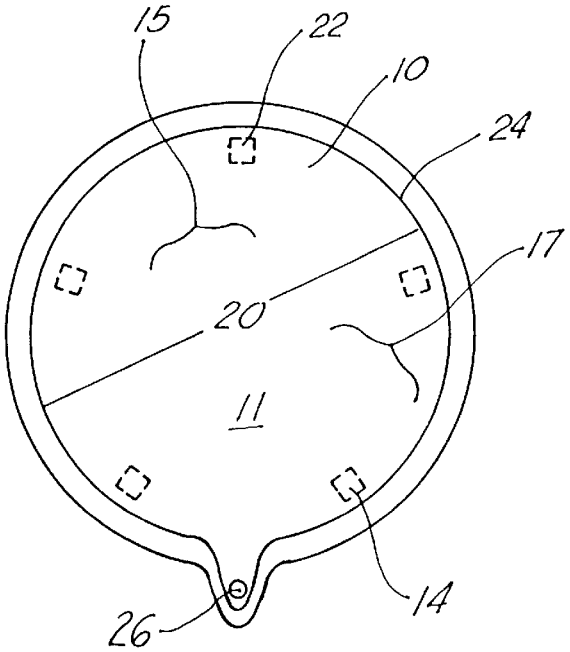
FIG. 2 is a side view of the first outer wall of an exemplary, uninflated balloon of MYLAR or the like, utilized in forming the system of FIG. 1.
Figure 3:
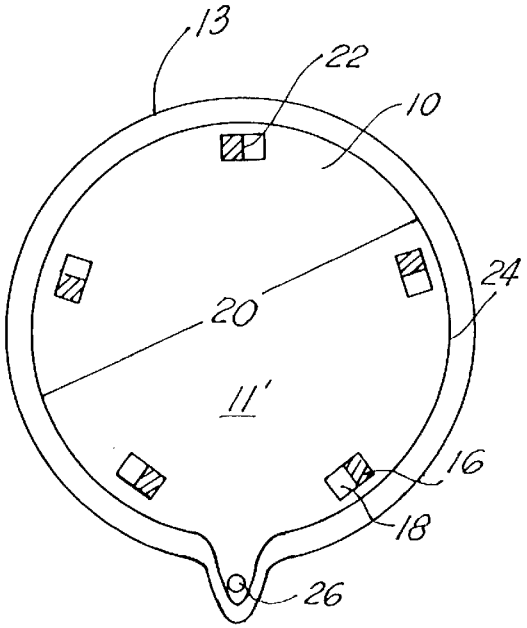
FIG. 3 is a side view of the second outer wall of the exemplary balloon of FIG. 2, illustrating the various components of same, as well as the placement of the polar contact fasteners.

Referring to FIGS. 1–3, the preferred embodiment of the present invention contemplates a modular system of inflated cells having connection members placed in the vicinity of each cells periphery, said cells configured to form various polyhedral shapes. The preferred embodiment of the present invention teaches the utilization of a generally ellipsoidal balloon 12 of a non-elastomeric material, such as MYLAR, each said ellipsoid forming a cell, and being configured to selectively engage neighboring balloons.

Continuing with FIG. 1, a dodecahedral circular balloon-face polyhedron is shown, which is composed of twelve circular non-elastomeric balloons 12 connected by contact fasteners 14 (FIGS. 1–3) at natural connection points 22 for this structure.

In the inflated state, balloon 12 is formed of a generally ellipsoidal, gas filled envelope 10 having an first outer wall 11 a second outer wall 11', and a peripheral edge 13. From the peripheral edge, opposing walls separate with a radius of curvature that is small compared to relatively flat center surface 15, and an outwardly expanding transitional area 17 juxtaposed between the peripheral edge and said relatively flat center surface.

Contact fasteners 14 used in balloon-face polyhedra may be composed of multiple parts, as in a positive polarity or male contact fastener 16 and a negative polarity or female contact fastener 18, or may be a single component non-polar contact fastener. In both cases the contact fasteners 14 are connected to the envelope 10 by means of adhesive or other method typically used to connect two flat members. The envelope referred to here is the material used to enclose the fill material of the balloon and form the body of the balloon.

The natural connection points for this structure are relatively easy to determine using prototypes or CAD models. First, the distance from the seam or periphery to the natural connection points are measured based on the fully inflated topology of the balloon faces in final polyhedral configuration. Then, in order for these measurements to be used in manufacturing of balloons at all scales, the distance from the seam to the connection point is expressed in proportion to the uninflated diameter 20 (UID) of the balloons, or some similar scale measure.

For the dodecahedral circle balloon-face polyhedron of FIG. 1, contact fasteners 14 should be arranged pentagonally, with five equidistantly spaced connection points 22, situated in the transitional area 17 between the generally flat, center surface 15 and the peripheral edge 13. The spaced location of the connection points may be calculated by the following formula, as an example:

Formula A dodecahedral distance from seam [24] to connection point [22]= 0.12* uninflated diameter (UID) [20].

The complete area to be covered by the contact fastener is defined by a circle of a radius centered at the connection point with sufficient hold for the given application. The area covered need not be circular, as long as the same area is covered.

FIG. 2 shows a detailed view of an uninflated component balloon 12 of FIG. 1 using non-polar contact fasteners 14. One example of a non-polar contact fastener is a self-adhesive patch. The non-polar contact fasteners should cover approximately 0.5 square inches for typical adhesives.

FIG. 3 shows a detailed view of an uninflated component balloon 12 of FIG. 1 using polar contact fasteners 16 and 18. Examples of polar contact fasteners include hook-and-loop fasteners and magnetic fasteners. The polar contact fasteners should cover approximately 1 square inch for typical hook-and-loop, for example. Hook and loop, and other polar contact fasteners, typically require a male fastener to adhere to a female fastener, and vice versa.

Since it is known that the connections will form a pentagon on each face, the designer would have to arrange the strips on the balloon such that the strips of positive polarity contact fastener are adjacent to and should, ideally, be to the left of strips of negative polarity contact fastener, arranged pentagonally (in this example), and radiating from the centers of the twelve component balloons to the seam, in the above described area, as shown in FIG. 3. Right and left are relative to an observer looking out from the center of a balloon face. This fastener configuration makes it very easy to connect a cell to like constructed cells.

The arrangement of positive and negative polarities of the polar contact fasteners is very important. A wide variety of arrangements is possible, but only if polar contact fasteners are arrayed such that for each edge of a face of a polyhedron being approximated (in this case, a dodecahedron), and male and female or positive and negative fasteners maintain a consistent left and right relationship to one another relative to an observer viewing the cell from the interior of the approximated polyhedron will the faces readily attach to one another. Without this consistent symmetry, users will require a map to determine how to connect the cells for all but very simple polyhedra.

In this instance, the positive and negative polarities of the polar contact fasteners 16 and 18 must be arranged symmetrically with respect to a line drawn from the center of the balloon 12 through the connection point 22.

Note that some polar contact fasteners are available in a form that stripes the positive and negative polarities. Flexible refrigerator magnets may be utilized in this fashion, as an example. Polar contact fasteners which are striped may be treated as non-polar contact fasteners, thereby avoiding the requirements for polar contact fasteners outlined in the preceding paragraph. However, polar contact fasteners that are not striped do provide fewer degrees of freedom at the connection point 22, thus simplifying assembly of symmetric structures.

Except for the fasteners, the envelope forming the exemplary balloon 12 of this embodiment will commonly be built according to the method described by Hurst in U.S. Pat. No. #4,077,588 and include a valve 26.

However, the methods described here will work for a wide variety of balloon objects including polyester stuffed fabric pillows, balloons of vinyl covered nylon, elastomeric balloons, and mesh covered structures.

OPERATION

Dodecahedral circle balloon-face polyhedron—FIGS. 1, 2, 3, 4, and 6

This embodiment is an extremely lightweight, inexpensive three dimensional object with good structural integrity, and readily assembled by untrained personnel. To make a structure, the user inflates the balloon faces by lung power or mechanical means, and then connects the balloons together at the connectors by bringing the balloons into close proximity with each other. No need for careful alignment.

Figure 7:
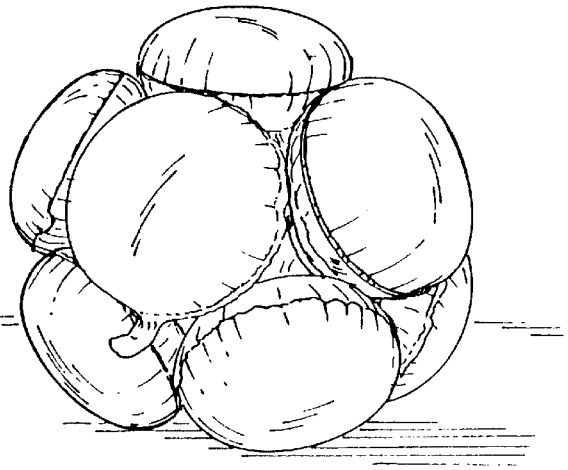
FIG. 7 is a side view of a sphere-configured assembly of the balloons of FIG. 1, illustrating the first assembly step in utilizing the balloon arrangement as an explosive cushion.
Figure 8:
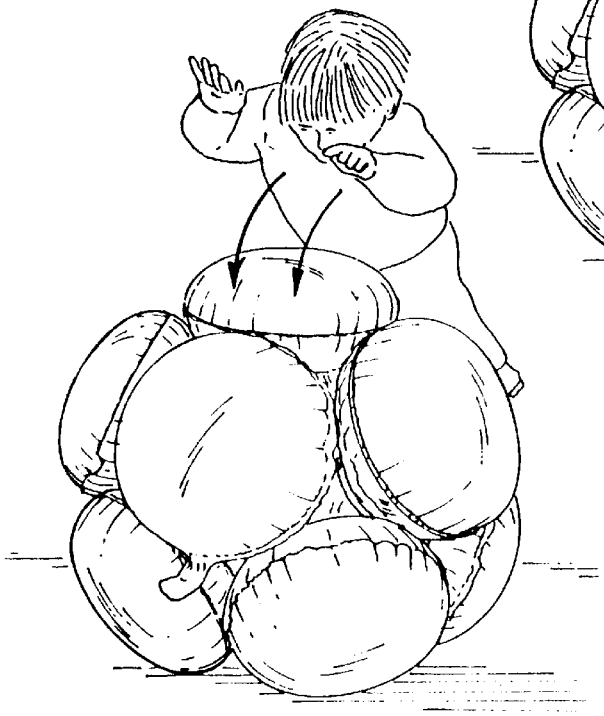
FIG. 8 is a side view of the invention of FIG. 7, illustrating the second step of utilizing the balloon arrangement as an explosive cushion, wherein a user pounces upon same.
Figure 9:
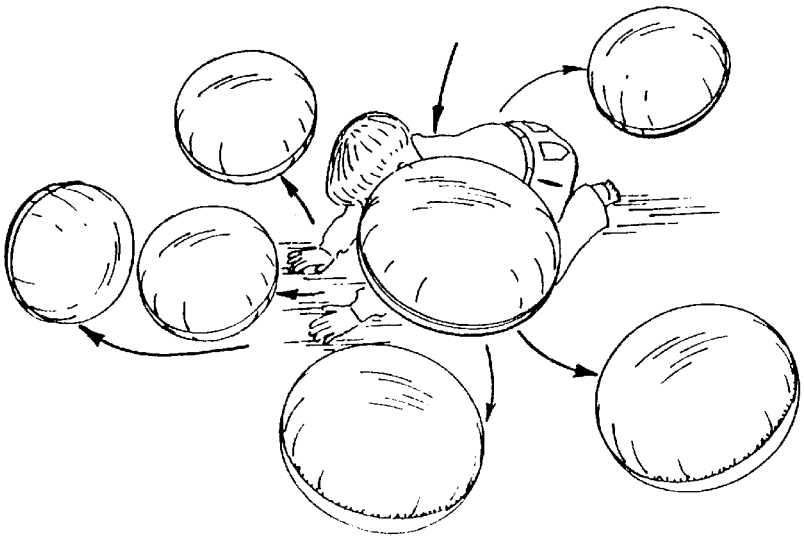
FIG. 9 is a generally isometric view of the invention of FIG. 7, illustrating the balloon contact fasteners breaking away upon the application of force of the user falling upon the balloon arrangement, and the balloons subsequently separating in diverse fashion.
Figure 10:
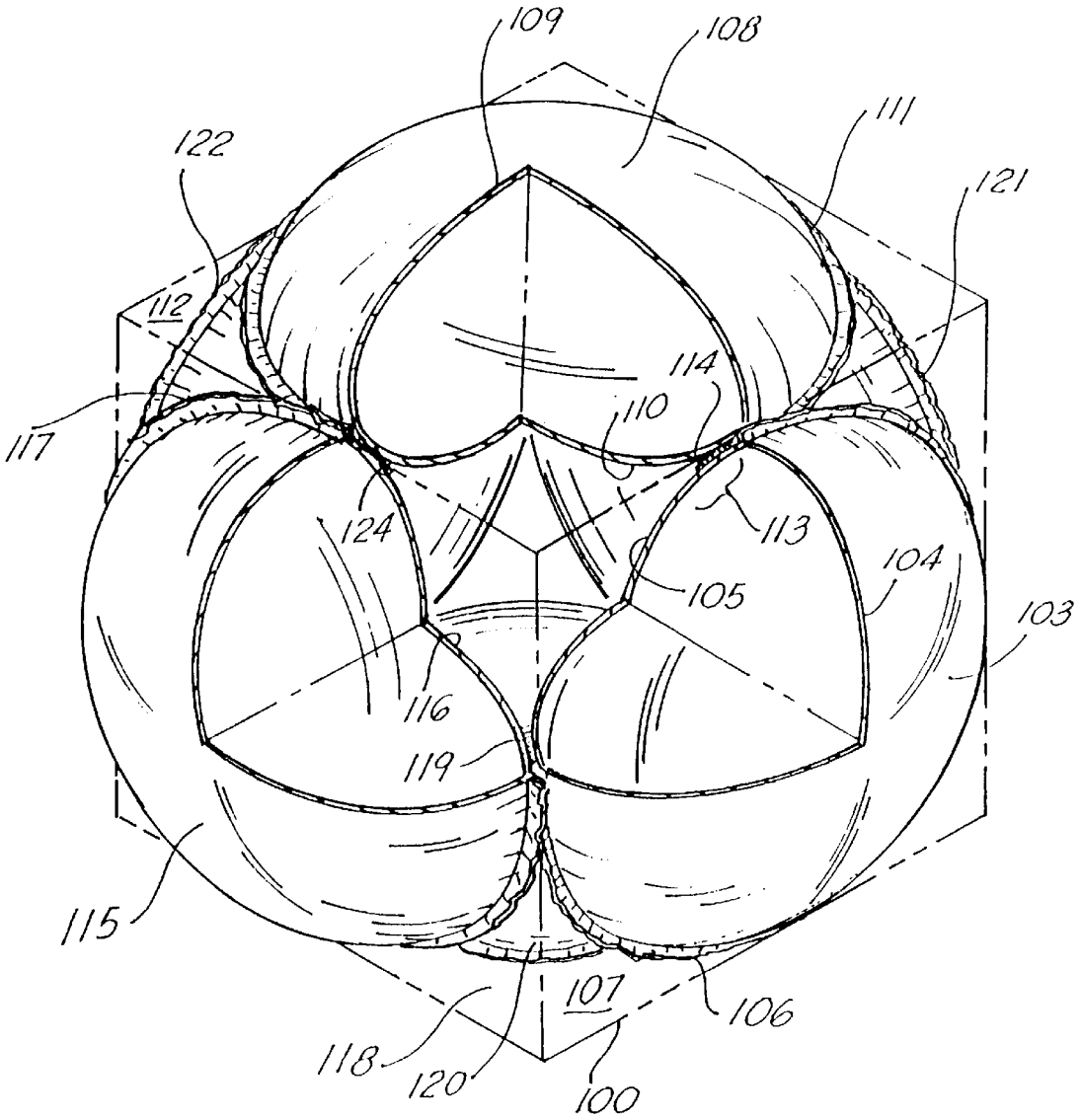
FIG. 10 illustrates the method of forming the present invention of FIG. 1, illustrating the balloons forming a generally cube-configured arrangement.

Disassembly is even easier than assembly. As shown in FIGS. 7–9 the user can simply jump onto the structure wedging it between the floor and the user's body and it will rapidly come apart, ready to reassemble if desired. If the user wants to more slowly disassemble the structure, the faces can be disconnected from each other one at a time by pulling the balloons away from each other. The balloons can then be deflated and stored for later use.

Children enjoy playing with these structures since the are so light weight and can be configured in many ways. 2 year-olds can easily throw around the room as a ball a dodecahedral circle balloon-face polyhedron 58 inches high weighing only 0.48 kilograms. A typical plush soccer ball for indoor use 8.5 inches in diameter weighs 0.385 kilograms, though having less than 15% the diameter. The integrated fasteners also adds to the safety of the invention.

Children also enjoy "exploding" the structures apart, as shown in FIGS. 7–9. They are very safe for child's play since they are resilient objects instead of the normal hard objects used for construction toys. Fractal reflections grace these structures when reflective surfaces are used on the interior of the structure, much like a kaleidoscope.

The balloons of this embodiment are connected such that lines connecting the centers of these balloons form triangles. That means that these are completely triangulated structures, giving them great strength.

The dodecahedral circle balloon-face polyhedron FIG. 1 is composed of the most equal diameter balloons possible for a spheroid always in double curvature. The circular balloons themselves have the best possible surface/volume ratio for a balloon made with all seams in the same plane. Thus this polyhedron is especially appropriate for strong, floating structures.

For the user this system offers many advantages 1) extreme ease of assembly
2) no reliance on frameworks
2) ultimate ease of disassembly
3) easily configured in different ways to form many different shapes
4) safe for play
5) air-floatable at small size
6) superior structural integrity due to 3D nature of the faces and triangulation
7) can be composed of printed balloons decorated to suit any occasion
8) inexpensive due to automated manufacture

DESCRIPTION

Circular Regular Polygon System—FIGS. 1, 2, 3, 4, 5, 11, 13, and 12

The dodecahedral balloon-face polyhedral structure of the first embodiment is actually a member of a polyhedral systems application, in which circular faces are used to represent regular polygons; triangles, squares, pentagons, and hexagons. This is called the circular regular polygon system.

In this system, circular balloons are used to represent regular polygons by modifying the radius and number of connectors. Torroids may also be used in place of circular balloons, though they are not as strong and have a poorer surface area to volume ratio than circular balloons.

Since it is known that the connections will form regular polygons on each face, strips of positive polarity contact fastener immediately adjacent to and always to the left of strips of negative polarity contact fastener may be arranged according to the appropriate polygon and radiating from the centers of the twelve component balloons to the seam, as shown for circular pentagon balloons. Right and left are relative to an observer looking out from the center of a balloon face.

Figure 4:
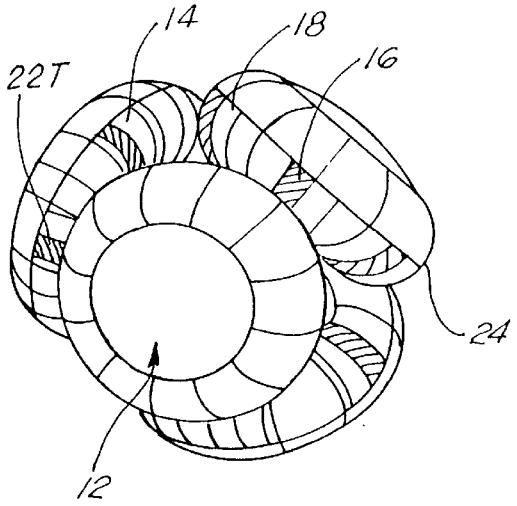
FIG. 4 is an isometric view of a tetrahedra formed utilizing the system of the present invention.
Figure 5:
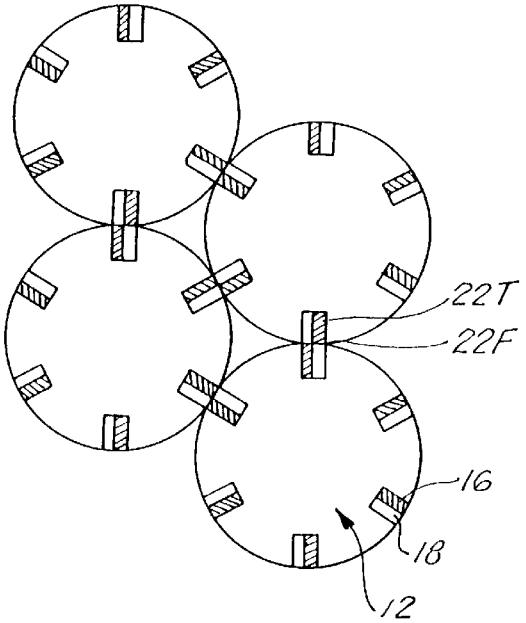
FIG. 5 is a top view of the partially unassembled balloons of FIG. 4, illustrating the fastener positioning, configuration, and range of dihedral angles for forming a tetrahedra.

When the component balloons are to be used in a variety of configurations as in FIGS. 4 & 5, then it may be desirable to have the contact fastener 14 cover connection points 22*t* for tetrahedra FIG. 4, the most compact polyhedron possible, to connection points 22*f* for planar configuration, as shown in FIG. 5. Balloons may even have fasteners from the center to the seam to allow an extremely broad range of connections.

The system described below has contact fasteners 14 running from the natural connection point for the regular polyhedron composed of all like circular polygon balloons to the seam 24. This choice of contact fastener length may be dramatically shortened if the device desired needs to be lighter to be air floatable. Very little contact fastener at the natural connection point will hold a structure together, but multi-configurability is compromised.

Circular, triangularly arranged balloons as in FIGS. 4, 5, 6 should have three polar contact fasteners 16 and 18 running from the seam 24 to a connection point calculated according to the formula below:

Formula B tetrahedral distance from seam [24] to connection point [22]=0.189* uninflated diameter (UID) [20]

Alternatively, these balloons may have six connectors so that the balloons that the circular triangle balloons can act as circular hexagon balloons for smaller structures.

Figure 6:
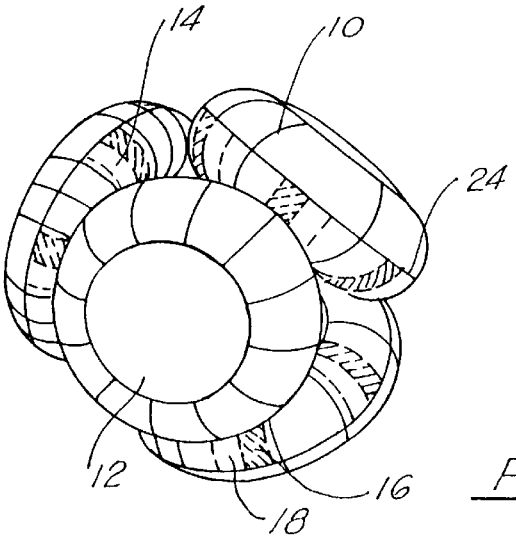
FIG. 6 is an isometric view of an alternative embodiment of the tetrahedra of FIG. 4, wherein internally situated, magnetic strip polar contact fasteners are illustrated.

FIG. 6 shows a tetrahedron of circular triangle balloons where magnetic polar contact fasteners 16 and 18 are adhered to the inside of the balloon envelope 10. This allows the outside of the balloon to be made very smooth and for connections to be made and severed with little of the noise observed with hook-and-loop fasteners. Circular square balloons as in FIG. 11 should have four polar contact fasteners 16 and 18 running from the seam 24 to a connection point calculated according to the formula below:

Formula C cube distance from seam [24] to connection point [22]=0.158* uninflated diameter (UID) [20]

The circular square balloons 12 should have a radius 1.732 times as large as the circular triangle balloons. The balloon connecting the two cubes shown in FIG. 11 must have polar contact fasteners 16 and 18 on both sides. Additionally, circular triangle and circular square balloons may be combined to build a circle-faced cube-octahedron.

Figure 11:
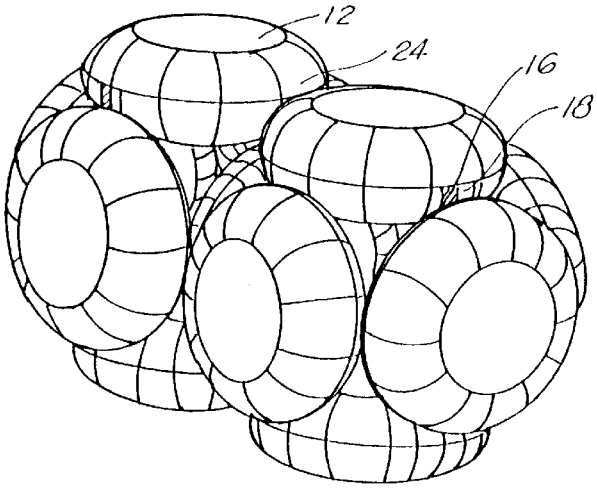
FIG. 11 illustrates two connected cubes built according to this invention.

FIG. 11 gives further detail illustrating the basic concepts behind a multi-unit structure of this invention approximating a polyhedron 100 (a cube), said polyhedron having first 107 and second 112, adjacent faces.

As shown, there is further provided a first balloon 103 having a somewhat three dimensional structure formed from a flexible envelope 104 substantially impermeable to, and filled with, a supporting fill material (in this example, air), said envelope having an outer surface 105 and a peripheral edge 106, Situated adjacent to the first balloon is a second balloon 108, also forming a three dimensional structure formed from a flexible envelope 109 substantially impermeable to, and filled with, a supporting fill material, said envelope having an outer surface 110 and a peripheral edge 111.

As shown, the peripheral edges 106, 111 of said first 103 and second 108 balloons are co-planar with first 107 and second 112, adjacent faces of said cube 100, and a portion of said outer surface 105 of said first balloon is positioned to contact said outer surface 110 of said second balloon, defining a connection area 113 between the outer surfaces of said first and second balloons.

As shown, there is further provided contact fastening means 114, in this case, hook and loop fasteners, for selectively anchoring said first balloon outer surface 105 to said second balloon outer surface 110 at said connection area 113.

Further, there is placed an additional, third balloon 115 in the vicinity of the above balloons 103, 108, this third balloon 115 further comprising an envelope having an outer surface 116 and a peripheral edge 117.

As shown, the third balloon 115 is positioned such that the peripheral edges 106, 111, 117 of said first 103, second 108, and third 115 balloons are co-planar with first 107, second 112, and third 118 adjacent faces of said cube 100, and a portion of said outer surfaces 105, 110 of said first and second balloons, respectively, are positioned to contact said outer surface 116 of said third balloon, defining a connection areas 119, 124 between the outer surfaces of said first, second, and third balloons.

In completing the present cube 100, fourth 120, fifth, 121, and sixth 122 balloons are provided, likewise having peripheral edges which are positioned to be in co-planar alignment with adjacent faces of the cube, further defining their connection points wherein the contact fastener, as indicated, in this case, hook and loop, is to be positioned for attachment, securing the multi-celled, balloon formed structure in the desired polyhedral configuration.

Circular pentagon balloons as in FIGS. 1, 2, 3, and 13 should have five polar contact fasteners 16 and 18 running from the seam 24 to a connection point calculated according to the formula below:

Formula A dodecahedral distance from seam [24] to connection point [22]= 0.12* uninflated diameter (UID) [20]

The circular pentagon balloons should have a radius 2.384 times as large as the circular triangle balloons.

Figure 13:
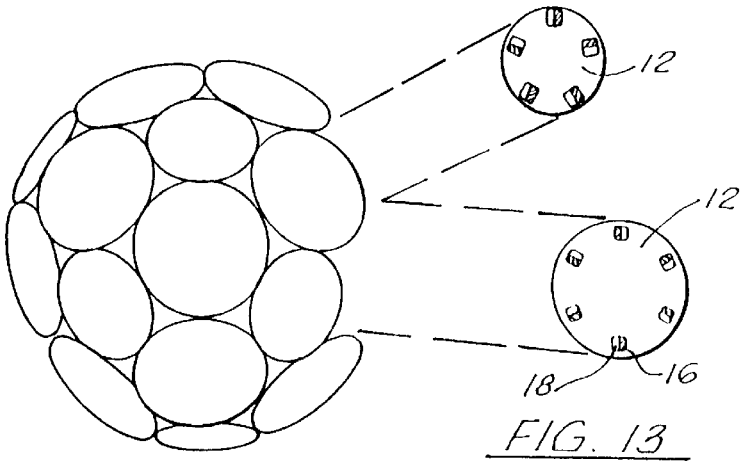
FIG. 13 illustrates a truncated isohedral structure.
Figure 14:
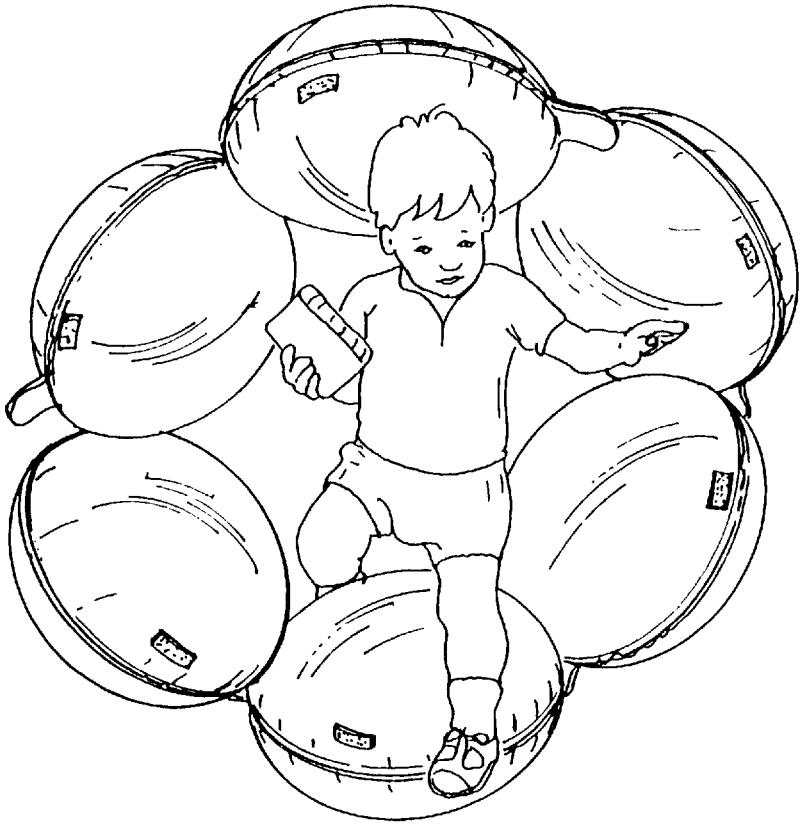
FIG. 14 illustrates a ring constructed of the balloons of FIGS. 2 & 3.

Circular hexagon balloons as in the circle-faced truncated icosahedron in FIG. 13 should have six polar contact fasteners 16 and 18 similar to those of the circular triangle balloons earlier described. This length of contact fastener allows them to be connected as triangles in a tetrahedron as well as hexagons. They should have a radius 3 times as large as the circular triangle balloons.

The table below summarizes the primary requirements for this system:

TABLE 3

| Circular | Distance from seam[24] Polygon to connection point | radius | # connectors [22] |
|---|---|---|---|
| Triangle | .189 UID | 1.000 | 3 or 6 |
| Square | .158 UID | 1.732 | 4 |
| pentagon | .120 UID | 2.384 | 5 |
| hexagon | .189 UID | 3.000 | 6 |

To define the complete area to be covered by the contact fastener circles of a radius with area sufficient to hold for a given application are traced along a path from the connection point to the maximum seamward extent required.

Figure 12:
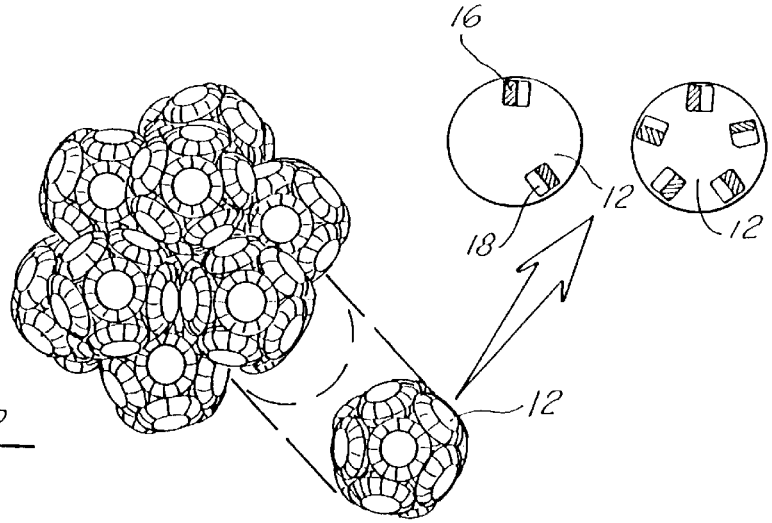
FIG. 12 illustrates a dodecahedral structure built of twelve dodecahedral balloon-face polyhedra; a compound polyhedron.

Balloon-face polyhedral structures can also be built with smaller balloon-face polyhedra as components. These are called compound balloon-face polyhedral structures. FIG. 12 shows a dodecahedral structure built of twelve dodecahedral balloon-face polyhedra. To build this structure polar contact fasteners 16 and 18 are placed on both sides of the balloon components. This allows all of the component dodecahedral balloon-face polyhedra to be connected to their neighbors. A simpler example based on the cube is shown in FIG. 11.

Compound balloon-face polyhedral structures can be built to any degree of compounding. FIG. 12 is a two level compound structure since its components are built of components.

Structures of any degree may be built with a dramatic decrease in the amount of fill material required with each level of compounding. Compound balloon-face polyhedral structures can combine components of many shapes to create highly complex light weight structures of any size.

Note that these compound structures may also be built combining elements at different levels of compounding. In this instance, any of the twelve component dodecahedral balloon-face polyhedra may be replaced by a single sphere.

Another feature of the Circular Regular Polygon System is the ability of component balloons to act as one polygon (like a triangle) on one side and another polygon (like a square) on the other. For example, a cube connected to a tetrahedron via a balloon with a triangle pattern on one side and square pattern on the other. This also opens the possibility of multiple polygons on the same side for use in different figures.

OPERATION

Circular Regular Polygon System—FIGS. 1, 2, 3, 4, 5, 11, 13

The circular regular polygon system defined above allows for a wide variety of structures to be built, as shown in FIGS. 1, 4, 5, 11, and 13. Note that the variety of configurations is even greater than with the rigid polygonal faces of U.S. Pat. No. 4,836,787 since the balloons are flexible, to a degree. The torroids, arches, rings, etc. possible with balloon-face polyhedra are impossible with rigid components, in the prior art.

Of particular interest here are the tetrahedral circle balloon-face polyhedron FIG. 4, cubic circle balloon-face polyhedron FIG. 11, and dodecahedral circle balloon-face polyhedron FIG. 1. These polyhedra are all composed of single size circular balloons. They also are connected such that lines connecting the centers of these balloons form triangles. That means that these are completely triangulated structures, giving them great strength.

Geodesic domes of high frequency can also be made utilizing the system of the present invention. A 1-frequency truncated icosahedron can be built of circular pentagons and hexagons for a total of 32 faces. If built in the circular polyhedral system of 34 inch circular hexagon balloons, the largest commonly available, a spheroid approximately 13 ft. tall can be built weighing approximately 1.2 kilograms when air inflated and capable of floating in air when the balloons are helium inflated.

The 1-frequency truncated icosahedron is the largest possible spheroid always in double curvature using only circular balloons. Higher frequency structures of the truncated icosahedron family require balloons of pseudo-elliptical shape that are tangential to the irregular hexagonal faces they fit. These pseudo-elliptical balloons will always be of sizes intermediate between the pentagon and hexagon balloons. This makes floating structures of great size possible using components small enough to be made on modern decorative balloon production equipment.

Geodesic balloon-face polyhedra composed of balloons with straight edges are also useful, including those of hexagons and pentagons and those of triangles. The user must simply choose the most appropriate system for the given situation.

Geodesic spheres, such as illustrated in FIG. 13, composed of balloon faces can be built in the same fashion as other balloon face polyhedral structures. They lend themselves particularly well to applications such as signage. For signage, the balloon faces would be assembled for most of the sphere, then a balloon for lift can be added to the center. Lift may also be induced by filling the balloon face themselves with helium, but by separating the structure from the lift mechanism disfigurement by loss of helium can be avoided.

Balloon-face polyhedra built using contact fasteners 14 actually tend to self-assemble to varying degrees. One way to experiment with self-assembly is to place components of a polyhedron in a large container and shake it. The pieces will connect to each other in many different ways depending on such variables as the contact fastener type, weight of the balloons, and size of the container.

The most symmetric self-assembled structures may be achieved using magnetic polar contact fasteners 16 and 18 as shown in FIG. 6. The magnetic polar contact fasteners 16 and 18 are adhered to the inside of the balloon envelope 10. This allows the outside of the balloon to be made very smooth so that the balloon components 12 tend to pivot at the connections until a triangulated configuration which limits pivoting movement is achieved.

DESCRIPTION

Figure 15:
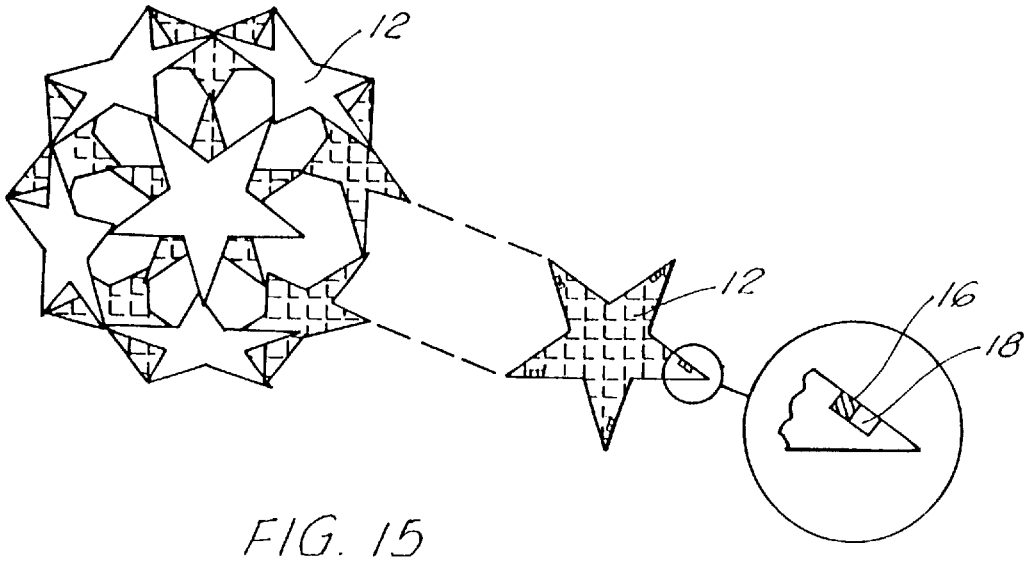
FIG. 15 illustrates a star-faced dodecahedron.
Figure 16:
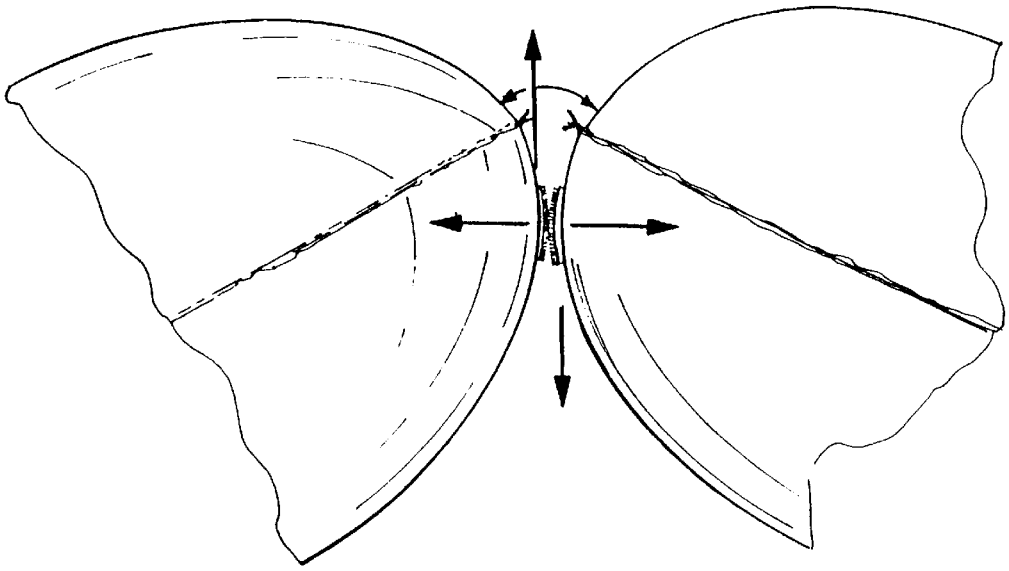
FIG. 16 illustrates the various shear, pull, tension, peeling, and other forces acting upon the polar connectors of two exemplary attached neighboring balloons.

Star System—FIG. 15

Face shapes other than circles are also useful. Straight sided balloons can be built in a triangle/square/pentagon/hexagon system much as shown above for circular faces. In addition some quite novel polyhedra may be built using face shapes not normally associated with polyhedra.

One example is the star regular polygon system. In the star regular polygon system balloons are constructed with three, four, five, and six points. These points should fall on the same circles defined by the radii given in Table 3.

The polar contact fasteners 16 and 18 must be located at the natural connection points for this shape in a manner similar to that shown in FIG. 15, a star-faced dodecahedron. Note that all contact fasteners must be to the same side of a line connecting the center of the balloon to the point. FIG. 15 shows all contact fasteners to the right of the line.

If polar contact fasteners are used, they can be either parallel or perpendicular to and a line connecting the center of the balloon to the point, though this is insufficient to provide full contact of the fasteners. Full contact of positive to negative contact fastener can be made if the line between positive and negative connectors on a given balloon is parallel to a line which bisects the angle between balloons being connected.

Circular, straight-edge and star faces are by no means the only face shapes possible. Any shape that has sufficient structural integrity for the application and can contact adjacent faces at the connection points will work; spheres, struts, teddy bears, and other shapes can all work.

OPERATION

Star System—FIG. 15

The Star system is used in the same way as other balloon-face polyhedra. They do offer advantages in special cases. The stars are excellent decorations for special occasions and also are useful in highlighting the geometries of certain polyhedra. It also allows for easy visibility into the interior of the structure.

DESCRIPTION

Figure 18:
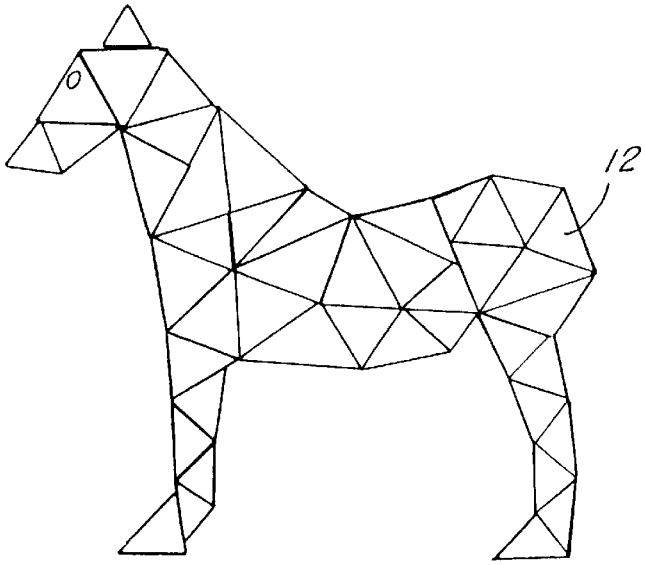
FIG. 18 illustrates a horse formed with multiple triangular cells, as illustrated in FIG. 19.
Figure 19:
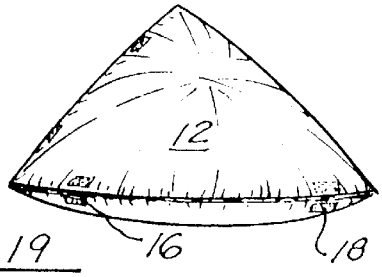
FIG. 19 is an alternative embodiment of the present invention, illustrating a triangular cell.

General Structures—FIGS. 18 & 19

Any inflatable shape can be created using balloon-face polyhedral structures yielding a structure that requires much less gas to inflate than a single balloon system. The balloon-face polyhedral structure can be built on automated equipment, and be readily broken down into small components.

To do this the shape should be subdivided into polygons; triangles being the easiest to design. Once the shape is subdivided into triangles, the triangle edges are rounded so that they are straight when inflated, as shown in FIG. 19. A horse-shaped balloon-face polyhedral structure is shown in FIG. 18 composed of triangular balloons 12 connected by polar contact fasteners 16 and 18 FIG. 19.

These three dimensional triangular faces will be difficult to treat mathematically to find natural connection points 22, though some CAD programs allow it to be done in software.

Alternatively the prototype may be built with excessive coverage of fastening material arranged in alternating squares of positive and negative polar contact fastener and then the natural connection points can be measured. In the extreme, the entire balloon may be covered with a small pattern of alternating positive and negative polarity contact fasteners.

Structures can also be subdivided into hexagons and pentagons creating less complicated junctions than triangle-based systems.

This type of structure also lends itself to replacement of the hexagons and pentagons with circles, stars, or other shapes. Because of the triple junctions, the structures are naturally triangulated and structural integrity can be maintained with arbitrary shapes easily.

OPERATION

General Structures—FIGS. 18 & 19

The general system described above is particularly useful for creating large balloon structures. Once the balloons are designed, automated equipment can be used to create many of the structures inexpensively. The resulting structures will require far less fill material than single envelope structures and be much easier to maintain, since balloon faces can be readily replaced.

The extreme example of covering entire balloons with contact fasteners allows children the opportunity to connect them in any desired fashion.

DESCRIPTION and OPERATION

Figure 17:
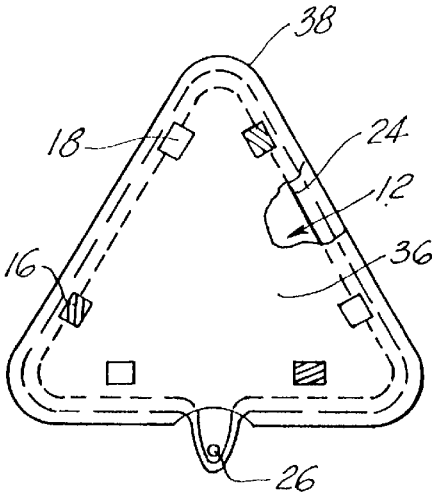
FIG. 17 illustrates a covered triangular balloon embodiment of the present invention.

Envelope Reinforcement—FIG. 17

Envelope reinforcements come in many types. The principles guiding balloon reinforcement are thoroughly covered in books like Pneumatic Structures, Herzog 1976 and in U.S. Patents like Bird U.S. Pat. No. 3,744,191. These references give sufficient information for balloon envelopes to be built to withstand very high stresses and be built to very large sizes.

A few systems likely to be important for balloon-face polyhedral structures are ripstop nylon covers for balloons, nylon mesh covers for balloons, and materials to which the hooks of hook-and-loop fasteners will attach. The fasteners can be sewn to these materials and a normal balloon placed inside, as shown in FIG. 17, which shows a triangular cover 36 with sewn seam 38 over a balloon 12. A side benefit to this approach is that the balloons themselves do not necessarily need to be the same shape as the covers, so only one balloon could be used to fill out several different shapes of balloon covers. In this instance a circular balloon could also fill the cover. Note that if the cover 36 in FIG. 17 is made of a material to which the hooks of hook-and-loop fasteners will attach, the loop contact fasteners 18 can be omitted.

DESCRIPTION and OPERATION

Fill Materials

Fill materials can dramatically change performance characteristics of balloon-face polyhedral structures. Helium fill can produce air-floatable structures of great elegance. Air fill can produce very lightweight structures that maintain shape for longer periods than helium inflated structures.

In some instances weight is not as large an issue as structural integrity. In these cases, the balloons may be filled with polyurethane foam, polystyrene pellets, polyester batting, or other materials. The best choices are materials that maintain their flexibility under planned use conditions. Once non-gaseous fills are used, the materials of the balloon envelope can be changed drastically, since gas permeability is no longer an issue. In the extreme, the balloon envelope may be dispensed with altogether, the same principles of contact fastener geometry apply. With such alternative materials, it may be advantageous to have provided in the envelope, in lieu of a valve, a zipper other selectively closeable opening.

DESCRIPTION and OPERATION

Valves

Valves 26 of many types may be used for balloon-face polyhedral structures. Valves 26 using designs described in U.S. Pat. Nos. 4,842,007 and 4,917,646 are commonly seen in non-elastomeric helium balloons today. They do work well and are light weight. The drawback of these valves 26 is that they require a stiff hollow tube, such as a drinking straw, to deflate them.

Valves 26 like those used in many inflatable water toys are more suitable where weight is not as large an issue as deflatability. Another option when deflation speed is an issue is to have two valves, one for inflation and one for deflation as commonly seen on inflatable mattresses.

SUMMARY, RAMIFICATIONS, and SCOPE

The reader will see that Balloon-face Polyhedra offer extraordinary balloon structures with:

1) extreme ease of assembly
2) independence of frameworks
3) ultimate ease of disassembly
4) ease of multi-configuration
5) play safety
6) air-floatability at small size
7) superior structural integrity
8) ready decorability to suit any occasion
9) suitability to automated manufacture Though the description above contains many specifics, these should not be construed as limiting the scope of the invention but as merely providing illustrations of some of the presently preferred embodiments of this invention.

For example, Balloon-face polyhedra may be made self-inflating, may be built to maintain neutral buoyancy when helium filled to simulate conditions in orbit, assembled into animal shapes and used as piñatas for parties, bells can be put into the balloons to add attraction, they can be built as sets of nesting spheres or other shapes, etc.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A multi-unit structure approximating a least a portion of a polyhedron, said polyhedron comprising first and second, adjacent faces, said system further comprising:

a first unit having a structure filled with a supporting fill material, said structure having an outer surface and an outer periphery, said outer periphery defining a first plane;

a second unit having structure filled with a supporting fill material, said structure having an outer surface and an outer periphery, said outer periphery defining a second plane;

said first and second planes being situated in generally tangential fashion with said first and second adjacent faces of said polyhedron, respectively, such that a portion of said outer surface of said first unit is positioned adjacent to said outer surface of said second unit, defining a connection area between said outer surfaces of said first and second units;

fastening means for anchoring said first unit outer surface to said second unit outer surface at said connection area, said fastening means situated in the vicinity of said connection area.

2. The unit of claim 1, wherein said fastening means comprises fastener members spaced in relatively equidistant fashion.

3. The unit of claim 2, wherein each of said fastener members are equidistantly spaced relative to said outer peripheries of said first and second units, respectively.

4. The unit of claim 1, wherein said fastening means comprises polar contact fasteners.

5. The unit of claim 4, wherein said polar contact fasteners comprises adjacent female and male fastener members.

6. The unit of claim 4 wherein said polar contact fasteners are arrayed such that for each periphery of said face of said polyhedron being approximated, male and female or positive and negative fasteners maintain a consistent left and right relationship to one another relative to an observer viewing said unit from the interior of said polyhedron, such arrangement providing ready means of connecting said unit to any other similarly designed unit.

7. The unit of claim 5, wherein said male fastener member comprises hook material, and said female fastener member comprises loop material.

8. The unit of claim 4, wherein said polar contact fasteners are magnetic.

9. The unit of claim 1, wherein said fastening means comprises adhesive.

10. The unit of claim 1, wherein said first unit is filled with polystyrene.

11. A method of forming a structure, comprising the steps of:

a. forming a multi-unit structure approximating at least a portion of a polyhedron, said polyhedron comprising adjacent faces, said method further comprising the steps of:

b. providing a structural member, comprising:
a unit having a three dimensional structure formed from a container having an outer surface and an outer periphery, said outer periphery defining a plane;

c. providing another structural member, comprising:
an additional unit having a three dimensional structure formed from a container having an outer surface and a outer periphery, said outer periphery defining a plane;

d. affixing one of said units to another of said units, comprising the sub-steps of:
i. placing said one of said units in the vicinity of another of said units;
ii. situating said planes of said units in generally tangential alignment with said adjacent faces of said polyhedron, respectively, such that a portion of said outer surface of said one of said units is positioned adjacent to said outer surface of another of said units, defining a connection area between said outer surfaces of said units;
iii. selectively anchoring one of said unit outer surfaces to another of said unit outer surfaces at said connection area, in a manner so as to maintain said planes of said units in generally tangential alignment with said adjacent faces of said polyhedron, said anchoring accomplished in the vicinity of said connection area, on each of said units;

e. repeating steps b–d until the desired configuration is formed.

12. A device configured to disassemble with the application of force thereupon, comprising:

a multi-unit structure approximating at least a portion of a polyhedron, said polyhedron comprising first and second, adjacent faces, said system further comprising:

a first unit having a three dimensional structure formed from a structure having an outer surface and an outer periphery, said outer periphery defining a first plane;

a second unit having a three dimensional structure formed from a structure having an outer surface and an outer periphery, said outer periphery defining a second plane;

said first and second planes being situated in generally tangential fashion with said first and second adjacent faces of said polyhedron, respectively, such that a portion of said outer surface of said first unit is positioned adjacent to said outer surface of said second unit, defining a connection area between said outer surfaces of said first and second units;

anchoring means for anchoring said first unit outer surface to said second unit outer surface at said connection.

13. A method of fragmenting a structure, comprising the steps of:

a. forming a multi-unit structure approximating at least a portion of a polyhedron, said polyhedron comprising adjacent faces, said method further comprising the steps of:

b. providing a structural member, comprising:
a unit having an outer surface and a outer periphery, said outer periphery defining a plane;

c. providing another structural member, comprising:
an additional unit having an outer surface and a outer periphery, said outer periphery defining a plane;

d. affixing one of said units to another of said units, comprising the sub-steps of:
i. placing said one of said units in the vicinity of another of said units;
ii. situating said planes of said units in generally tangential alignment with said adjacent faces of said polyhedron, respectively, such that a portion of said outer surface of said one of said units is positioned adjacent to said outer surface of another of said units, defining a connection area between said outer surfaces of said units;
iii. anchoring one of said unit outer surfaces to another of said unit outer surfaces at said connection area, in a manner so as to maintain said planes of said units in generally tangential alignment with said adjacent faces of said polyhedron, said anchoring accomplished in the vicinity of said connection area, on each of said units.

e. repeating steps b–d until a structure is formed;

f applying pressure to said structure, un-fastening said fastener members;

g. randomly dislocating said structural members from one another, and distributing said dislocated units in random, spaced relationship from one another.

* * * * *